US008844777B2

(12) United States Patent
Ivison

(10) Patent No.: US 8,844,777 B2
(45) Date of Patent: Sep. 30, 2014

(54) PIN MOOR

(76) Inventor: Loretta Ivison, Santa Cruz, CA (US)

( * ) Notice: Subject to any disclaimer, the term of this patent is extended or adjusted under 35 U.S.C. 154(b) by 335 days.

(21) Appl. No.: 12/930,127

(22) Filed: Dec. 29, 2010

(65) Prior Publication Data

US 2011/0101045 A1 May 5, 2011

Related U.S. Application Data

(63) Continuation-in-part of application No. 11/273,239, filed on Nov. 14, 2005, now abandoned.

(60) Provisional application No. 61/341,864, filed on Apr. 6, 2010.

(51) Int. Cl.
*A41H 17/00* (2006.01)
*D05B 97/12* (2006.01)

(52) U.S. Cl.
CPC ..... *A41H 17/00* (2013.01); *D05B 97/12* (2013.01)
USPC ..... 223/109 R

(58) Field of Classification Search
USPC ..... 223/100, 102, 109 R; 24/51, 356, 380, 24/613, 1, 578.1, 253, 572.1, 900.1, 705, 24/595.1; 112/260; 206/365, 383, 583; 66/116–118
See application file for complete search history.

(56) References Cited

U.S. PATENT DOCUMENTS 38,817 A * 6/1863 Earle ..... 223/109 R
229,080 A * 6/1880 Ballou ..... 24/705
245,653 A * 8/1881 Naramore ..... 206/383
302,670 A * 7/1884 Poter ..... 223/100
526,746 A * 10/1894 Ruffner ..... 24/706.9
609,061 A * 8/1898 Waymack ..... 24/706.9
752,536 A * 2/1904 Duncombe ..... 223/109 R
997,474 A * 7/1911 Stuckel ..... 24/706.9
1,043,415 A * 11/1912 Gaunt et al. ..... 24/706.3
1,045,369 A * 11/1912 Burk ..... 24/707
1,258,345 A * 3/1918 Kilson ..... 24/706.9
2,016,601 A 10/1935 Havaty
2,040,289 A * 5/1936 Adams ..... 66/117
2,056,685 A * 10/1936 Miller ..... 24/355
2,262,568 A * 11/1941 Wade ..... 128/864
2,366,244 A * 1/1945 Ellerstein ..... 24/711.4
2,564,959 A * 8/1951 Corallo ..... 112/414
2,644,324 A * 7/1953 Spencer ..... 66/117
2,712,261 A * 7/1955 Anderson ..... 411/487
2,873,901 A * 2/1959 Liniger ..... 223/109 R
3,088,295 A * 5/1963 Haines ..... 63/20

(Continued)

*Primary Examiner* — Richale Quinn
(74) *Attorney, Agent, or Firm* — Jeffrey A Hall

(57) ABSTRACT

A moor or anchor (10) for pins (12), needles, or other sewing implements, comprising a moor or anchor having a first end and a second end, the first (14) and the second end (16) are connected by a central portion (30) which may be curved (18), whereby the moor or anchor (10) can be positioned on a surface (20) and receive a pin (12), needle, or other sewing implement to anchor a piece of fabric (19) to the surface. The surface (20) may be fabric, cloth, vinyl, plastic, or any other flexible material. The moor or anchor (10) may be configured in various shapes and include curved portions (18) and planar surfaces (26), and color-coded to facilitate use. A plurality of the moors or anchors are used to form a support and positioning network (50). A method for using the moor to secure and position pins and other sewing implements to surfaces such as fabric or other flexible material is also disclosed, allowing the formation of a surface support and positioning network (48).

16 Claims, 2 Drawing Sheets

(56) References Cited

U.S. PATENT DOCUMENTS

| | | | | | |
|---|---|---|---|---|---|
| 3,382,547 | A | * | 5/1968 | Hoefer | 24/711.4 |
| 3,415,246 | A | * | 12/1968 | Hill | 128/864 |
| 3,500,829 | A | * | 3/1970 | Abramowitz | 604/170.01 |
| 3,701,753 | A | * | 10/1972 | Shaw | 23/121 |
| 3,728,763 | A | * | 4/1973 | Warzecha | 24/711.4 |
| 3,811,437 | A | * | 5/1974 | Gardner, Jr. | 128/864 |
| 3,878,848 | A | * | 4/1975 | Hiebert | 606/148 |
| 3,947,930 | A | * | 4/1976 | Martens et al. | 340/572.7 |
| RE29,487 | E | * | 12/1977 | Gardner, Jr. | 128/864 |
| 4,134,183 | A | * | 1/1979 | Fischer | 24/132 |
| 4,404,713 | A | * | 9/1983 | Dorsey | 24/662 |
| 4,499,635 | A | * | 2/1985 | Ward | 24/711.2 |
| 4,501,050 | A | * | 2/1985 | Fountoulakis | 24/705 |
| 4,507,344 | A | * | 3/1985 | Baughman | 428/99 |
| D279,835 | S | * | 7/1985 | Gakiya | D3/28 |
| 4,579,112 | A | * | 4/1986 | Scott | 128/864 |
| 4,608,939 | A | * | 9/1986 | Lampley | 112/260 |
| 4,616,770 | A | * | 10/1986 | Johns | 223/101 |
| 4,653,292 | A | * | 3/1987 | Maupin et al. | 63/12 |
| 4,943,274 | A | * | 7/1990 | Edwards | 604/2 |
| 4,961,275 | A | * | 10/1990 | Klein | 40/1.5 |
| 5,027,545 | A | * | 7/1991 | Lowrie et al. | 43/44.92 |
| 5,170,542 | A | * | 12/1992 | Greenberg | 24/705 |
| 5,203,352 | A | * | 4/1993 | Gardner, Jr. | 128/864 |
| 5,343,663 | A | * | 9/1994 | Larrea et al. | 52/506.02 |
| 6,279,202 | B1 | * | 8/2001 | Wojdylak et al. | 24/12 |
| 6,408,981 | B1 | * | 6/2002 | Smith et al. | 181/126 |
| 6,439,382 | B1 | * | 8/2002 | Wolfe | 206/380 |
| D484,398 | S | * | 12/2003 | Mariconti et al. | D8/388 |
| 7,617,576 | B2 | * | 11/2009 | Tanio | 24/705 |
| D606,298 | S | * | 12/2009 | Sullivan | D3/28 |
| 8,052,017 | B2 | * | 11/2011 | Ivison | 223/109 R |
| 2003/0207108 | A1 | * | 11/2003 | Lauer | 428/376 |
| 2004/0062917 | A1 | * | 4/2004 | South | 428/200 |
| 2004/0102717 | A1 | * | 5/2004 | Qi | 600/583 |
| 2007/0074991 | A1 | * | 4/2007 | Heisserer | 206/438 |
| 2008/0289985 | A1 | * | 11/2008 | Pluth | 206/380 |
| 2009/0253818 | A1 | * | 10/2009 | Kimura et al. | 521/140 |
| 2011/0162567 | A1 | * | 7/2011 | Ivison | 112/475.01 |

* cited by examiner

PIN MOOR

CROSS REFERENCE TO RELATED APPLICATIONS

This application is a continuation-in-part of and claims priority from U.S. patent application Ser. No. 11/273,239, filed Nov. 14, 2005 now abandoned, and is related to and claims priority from PCT International Patent application PCT/US2006/037423 filed Sep. 26, 2006 and corresponding U.S. patent application Ser. No. 11/991,757 filed Mar. 10, 2008, and U.S. Provisional Patent Application 61/341,864, filed Apr. 6, 2010.

BACKGROUND OF THE INVENTION

1. Technical Field

This invention relates to sewing devices for holding and positioning pins or other sewing implements, and more particularly to a pin moor or anchor for securing pins and other sewing implements in a desired position, and for positioning pieces of fabric by creating a network of supporting and positioning anchors or moors on a fabric surface.

2. Background Art

Various devices have been proposed and implemented for holding and positioning articles. Although prior devices have been adapted and used for various purposes, there exists a need for a pin moor or anchor for positioning and securing pins or other sewing implements in a desired location on a quilt or other piece of fabric.

When making a quilt, sewers begin a quilt project typically use three layers of material. The top of the quilt which is usually the work area of the project, into which they have often invested large amounts of time to develop. The batting is positioned in the middle, and then there is a backing layer for the quilt. Holding these three layers of the quilt together has been an effort for sewers for hundreds of years.

In the past, there have been methods and devices proposed and implemented for this task. For example, basting with a needle and thread has been done for many years and is still used by some quilters, although it is very labor intensive and takes hours of time and effort to implement.

Another method of holding layers of cloth together in quilting and other sewing operations is the use of a safety pin. The primary difficulties with safety pins is that the safety pins are hard to close and often get in the way of the machine being used or the hand needle when the quilting is being done. There have also been proposed and implemented devices and methods to help open and close the safety pin in sewing and quilting operations.

Another example of devices to help position and hold fabric in quilting operations is a plastic gun device which is used to shoot plastic tabs through the three layers of fabric. Such device is difficult to use, is inconsistent in operation, and leaves large holes in the fabric. Further, the plastic tabs shot by such device are difficult to remove from the cloth.

The present invention provides a means and a method for holding pins and other sewing implements in position when quilting or during other sewing operations. Although pins are very useful, easy to move around, and do not put large holes in the fabric, and are an effective way to hold pieces of cloth together, when used alone, there is nothing to hold them in place. In fact, this is a significant limitation of using pins or other sewing implements alone. The pin moor or anchor of the present invention provides a means to anchor and securely position the pin in a desired position by forming a network of supporting and positioning structures on the surface of the fabric. With the pin moor or anchor attached to the sharp end of the pin, the pin only moves when someone moves it.

The present invention may also be used in the Appliqué part of the quilt making process where layers of fabric are piled onto one another and then sewed together. Typically, there are a variety of glues and safety pins used to hold the materials together. In this process the pin moor of the present invention is very useful and efficient, as the pins are anchored to a pin moor, and no longer move or shift position until the quilter wants them to. The layers of fabric are placed where the user wants and a pin is inserted into the layers of fabric and the pin moor. This secures the pin and fabric in place until it is moved or removed by the user while sewing the fabric layers together, either by hand or machine.

Accordingly, the primary object of the present invention is to provide a pin moor or anchor, which secures a pin and any attached cloth or fabric in desired location. By using a plurality of such pin moors or anchors a surface network of support and positioning structures is created. The pin moor or anchor may be easily positioned and secured where desired by partially piercing the moor or anchor on any surface, and is very easy to use and efficient in operation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purpose of the invention as embodied and broadly described herein, a portable, stable, moor for pins, needles, or other sewing implements is provided comprising a moor having a first end and a second end, the first and the second end are connected by a central portion which may be curved, whereby the moor can be positioned on a surface and receive a pin, needle, or other sewing implement to anchor a piece of cloth to the surface of another piece of cloth. The moor or anchor may be partially pierced on any surface or edge, and a plurality of such moors or anchors form a support and positioning network which is very useful and efficient. The moor may be configured in various shapes and include curved portions and planar surfaces. A method for using the moor to secure and position pins and other sewing implements to pieces of cloth is also disclosed.

BRIEF DESCRIPTION OF DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DETAILED DESCRIPTION OF THE PREFERRED EMBODIMENT

Reference will now be made in detail to the present preferred embodiments of the invention as illustrated in the accompanying drawings.

In accordance with the present invention, there is provided in a preferred embodiment of the invention, a portable, stable, moor or anchor for pins, needles, or other sewing implements, comprising, a moor having a first end and a second end, the first and the second end are connected by a central portion which may be curved, whereby the moor can be positioned on a surface and receive a pin, needle, or other sewing implement to anchor a piece of fabric to the surface. The surface may be any fabric, cloth, vinyl, plastic, or the like. A plurality of such moors or anchors are used to form a surface support and positioning network to aid and facilitate sewing and quilting operations.

Figure 1:
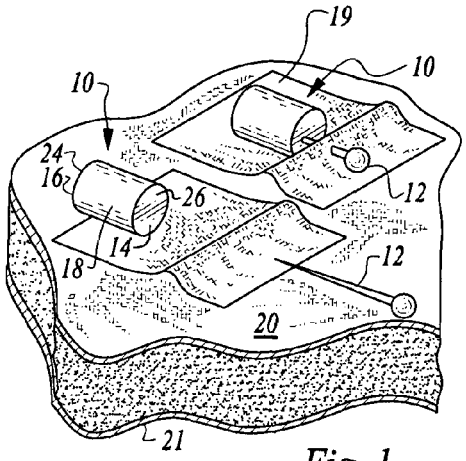
FIG. 1 shows a pin moor securing a pin and a piece of fabric to a quilt, according to the invention.

In FIG. 1, a preferred embodiment of pin moor or anchor 10, is shown. Preferably, moor 10, is utilized for receiving and securing pins 12, or other sewing implements such as needles therein. Moor 10 may be described herein as a moor or an anchor interchangeably. In a preferred embodiment, moor 10, has a first end 14, and a second end 16. The first and second end are connected by a curved portion 18, whereby moor 10, can be positioned on a surface, such as the surface of a quilt 20, or other surface, and receive a pin 12, needle, or other sewing implement to anchor a piece of fabric 19, to surface 20. Pin 12, may be partially inserted into any surface or edge of moor 10, to easily secure fabric thereto. This allows the moor or anchor 10 to be easily positioned anywhere on a fabric surface, and allows a plurality of such moors or anchors 10, to be used to create and form a surface network of support and positioning structures, 50. Surface 20, is shown as a quilt surface or batting, and may have backing 21, however, moor 10, may be used on any surface, such as fabric, cloth, vinyl, plastic or the like. Pin moor or anchor 10, is composed of a durable, resilient, pin penetrable material such as rubber, silicone rubber, plastic, foam, paper, neoprene, or the like, with silicone rubber being preferred. It is preferred that the material is not magnetic as this easily enables the user to separate the pins from the pin moor after use.

Silicone rubbers are generally grouped into five different classes and may be selected therefrom; those having only methyl groups on the polymer chain (polydimethyl siloxanes); those having methyl and vinyl substitutions on the polymer chain; those having methyl and phenyl substitutions on the polymer chain; those having methyl, phenyl and vinyl substitutions on the polymer chain; and those having fluoro, methyl and vinyl substitutions on the polymer chain.

In one embodiment, the pin moor or anchor 10, comprises a rubber of a hardness of about 10 to about 80 shore. In another embodiment, the hardness is from about 20 to about 50 shore, or alternatively about 30 to about 40 shore, or alternatively about 30 shore. The rubber can comprise silicone, polyurethane and the like. It is preferred that that rubber is not tin cured as this results in an unpleasant odor. Further, it is preferred that the moor comprise silicone rubber as it is know that such materials are exceptionally non-toxic.

Preferably, moor 10, for pins 12, needles, and other sewing implements has first end 14, which may be circular in configuration 22. However, as described below, other configurations may be used if desired. Moor 10, may be provided in any size desired, however, a preferred size is approximately ½ inch in length and ⅜ inch in diameter for the embodiment shown in FIGS. 1 and 2. In the preferred embodiment, pin moor or anchor 10 is solid so that pins or needles or other sewing implements may be secured by partially inserting the pin or needle or other implement in any surface or edge thereof. By use of a ½ inch length moor the user can easily determine how many stitches per inch which is very important in quilting. In use, a pin moor or anchor 10, of about ½ inch in length allows the user to gauge the stitch length and the number of stitches per inch.

Pin moor 10, is preferably color-coded 49, to allow the user to easily and logically position the moor to a chosen surface. For example, pin moor 10, may be provided in red, orange, green, violet, white, blue, light-blue, yellow, or the like, or any other chosen color and may be used to instruct the user as to the correct location and positioning of the moor or anchor for a chosen sewing or quilting operation. The chosen color may be provided by a pigment incorporated in liquid and applied to pin moor or anchor 10, or other color application method. Or the entire pin moor or anchor 10, may be colored by synthetic or natural means well known in the art. The liquid may be water or oil based or otherwise as desired, and the pigment may be natural or synthetic. Preferably, the pigment incorporated in the liquid is applied to curved portion 18 of central portion 30, and in some embodiments a different color pigment may be chosen for first end 14 and second end 16, or to the entire pin moor or anchor 10. Or the pin moor or anchor 10, may be colored by incorporating the color during the molding and manufacture process of the pin moor or anchor 10, and may be either partially or completely colored.

In one embodiment, a color-coded indicator, such as a letter, is incorporated on a surface of the moor or anchor. This allows the user to track the many pieces of quilt top before and during the assembly of the quilt top.

Figure 2:
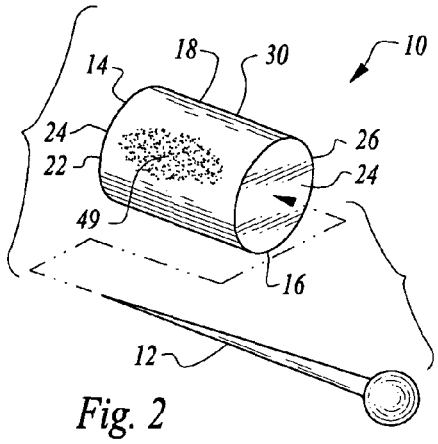
FIG. 2 shows a pin secured to a pin moor, according to the invention.

Preferably, pin moor or anchor 10, has central portion 30, being ½ inch in length and curved as seen in FIGS. 1 and 2. Central portion 30 is curved and cylindrical in shape, preferably surrounding a solid core of the moor or anchor 10, allowing for pins, needles or other sewing implement to be partially inserted in any surface thereof. Curved portion 18, Of central portion 30, forms a continuous curve in the preferred embodiment. That is, a cylindrical or pipe-like outer surface surrounding the aforementioned solid core. Central portion 30, is preferably ⅜ inch in diameter as is first end 14, and second end 16. First end 14, and second end 16, are preferably circular as shown and substantially flat as shown. The expanded circular flat region of first and second end 14 and 16, of the pin moor or anchor 10, provide a stable and easily used surface area. The configuration of the central portion 30, and first end 14 and second end 16, allow a plurality of pin moor or anchors 10, to form a surface network of support and positioning elements. This network may be formed as a net, a web, or as a linear array or other array configuration, depending on the quilting or sewing procedure. That is, if desired, pin moor or anchors 10, may be lined up in a selected spaced arrangement, or actually lined up touching each other in a linear fashion, or any other pattern, for example, to facilitate quilting and sewing procedures.

In a preferred embodiment, best seen in FIGS. 1 and 2, second end 16, is also circular 24, in configuration. As with first end 14, other configurations besides circular, such as rectangular, square, oval, or other geometric configurations may be used for second end 16, as well. Moor 10, may included one or more planar surfaces 26, such as first and second end, 14, and 16, which are shown as circular in configuration and planar as well.

Pin moor 10, provides an anchor mechanism for holding two or more layers of fabric together. Pin moor 10, with first end 14, and second end 16, has a connecting central portion 30, allows the anchor or moor 10, be positioned on a surface and receive a pin 12, to anchor a piece of fabric 19, to surface 20. Central portion 30, may be curved 24, as described above or otherwise. Preferably each surface of moor 10 is substantially continuous. In the embodiments shown in FIGS. 3, 4, and 5, connecting central portion 30, is not curved. A plurality of such pin moors or anchors 10, form a surface network supporting structures for positioning the layers of fabric together to aid and facilitate sewing or quilting operations.

Figure 3:
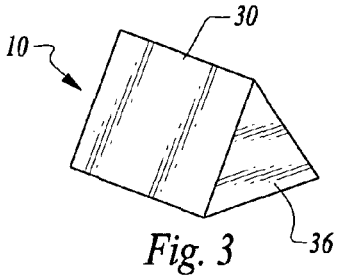
FIG. 3, shows a pin moor with a triangular face according to another embodiment of the invention.

In FIG. 3, an embodiment of pin moor or anchor 10, is shown in a shape having at least one face configured as a triangle, which may be a planar triangular surface 36, seen in FIG. 3.

Figure 4:
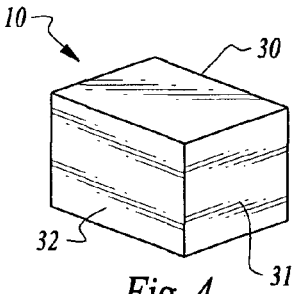
FIG. 4 shows a pin moor configured as a cube, according to another embodiment of the invention.

In FIG. 4, an embodiment of pin moor or anchor 10, is shown configured as a cube 32, with square sides 31.

Figure 5:
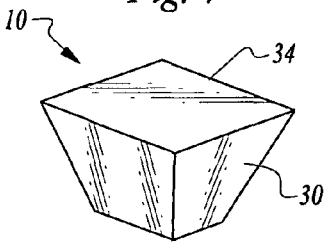
FIG. 5 shows a pin moor with a planar surface, according to the invention.
Figure 6:
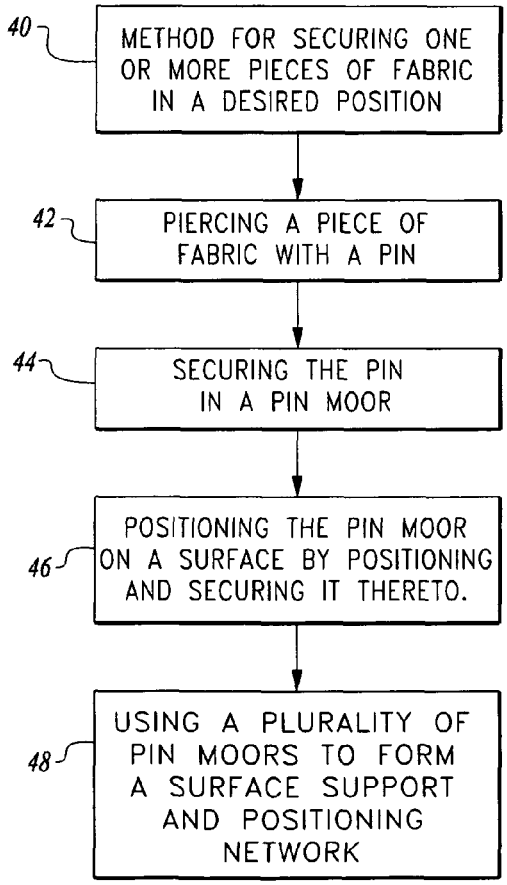
FIG. 6, is a flow chart of a methodology of holding a piece of fabric using a plurality of pin moor to form a surface support and positioning network, according to the invention.

With reference now to FIG. 5, pin moor or anchor 10, is shown with one or more planar surfaces configured as a rectangle 34.

Figure 7:
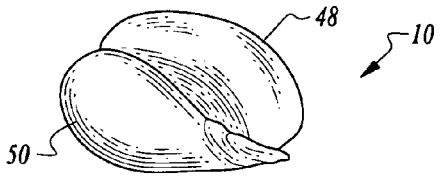
FIG. 7 shows a pin moor in an irregular configuration, here in a shell-shape, according to the invention.

In other embodiments, pin moor or anchor 10, may be configured for example, as a shell 48, with irregular edges 50, as seen in FIG. 7, or any other shape such as a leaf, fruit, vegetable, animal or any other irregular or abstract configuration.

Figure 8:
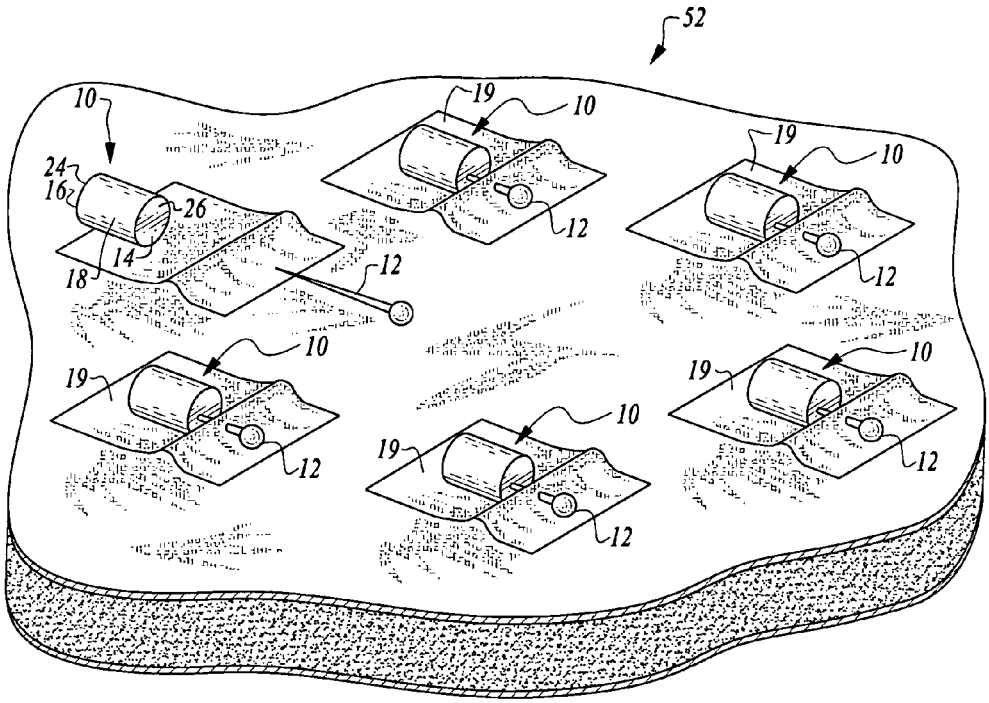
FIG. 8 shows a surface network of such moors to position and secure the fabric.

Using a plurality of moors or anchors 10, allows the user to form a surface network of support and positioning structures 52, seen in FIG. 8. Because the moor or anchor 10 may be secured by partially penetrating the pin, needle or other sewing implement partially into any surface or edge of the moor or anchor 10, the surface network can be created and fashioned to optimize sewing and quilting procedures, and to allow instruction by color-coding as to placement and procedure.

Using the pin moor or anchor 10, described in detail above, a method 40, for securing and positioning one or more pieces of fabric in a desired position is disclosed, preferably comprising the steps of: piercing a piece of fabric with a pin, step 42; securing the pin in a pin moor, step 44; and, positioning the pin moor on the surface of a second piece of fabric by positioning and securing the pin moor to the second piece of fabric, step 46, thereby forming a surface network supporting structure for positioning the layers of fabric together, step 48.

In operation and use, pin moor or anchor 10, is very easy to use, efficient, and reliable, for holding pieces of fabric together and positioning and securing a pin or other sewing implement in a desired location. Pin moor or anchor 10, may be used in quilting and other sewing operations and is inexpensive to manufacture and easy to use. Pin moor or anchor 10, may be provided in a wide variety of different sizes and configurations, and color-coded to provide instructional capabilities and facilitate sewing and quilting procedures. Pin moor or anchor 10, is also quite helpful in that it enables the user to keep track of stitches, the number of stitches and where stitches have already been made because the pin moor is so easy to remove from the fabric surface. Preferably pin moor or anchor 10, is composed of a durable, resilient, pin penetrable material such as silicone rubber, rubber, neoprene, plastic, foam, or the like.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A device for holding two or more pieces of fabric together in a desired position by a surface network of fabric positioning structures and color-coded indicators formed by a plurality of said devices so that a surface structure array of support and positioning structures is formed for correctly positioning said fabric for sewing or quilting operations and for increasing safety and operational speed of sewing or quilting procedures, comprising:

a pin moor having a first end and a second end, and a connecting solid central portion; said first end and said second end are substantially circular and have a flat surface thereto; and where said central portion is curved and colored to provide a color-coded indicator to aid in sewing or quilting procedures by instructing the user where to sew, what sequence, and what stitches to use, whereby said pin moor can be positioned on a fabric surface and receive a pin on any surface thereof, to anchor a piece of fabric to said surface of the pin moor, or to any edge thereof, by partially piercing the pin moor with said pin, so that a surface network of fabric positioning structures and instructional color-coded indicators is formed by a plurality of said pin moors forming said surface network structure array of support, instructional, and positioning structures which can be positioned on any surface of the fabric and repositioned in different configurations and sizes as desired.

2. The device of claim 1, wherein said first end and said second end are circular in configuration and have a diameter less than the length of said central connecting portion of said pin moor.

3. The device of claim 1, wherein said moor has one or more planar surfaces, and each surface of said moor is substantially continuous.

4. A device for holding two or more pieces of fabric together for sewing operations, for increasing safety and sewing speed, and confidence, where a surface network of fabric positioning structures and color-coded indicators is formed by a plurality of said devices so that a surface network structure array of fabric support, instructional, and positioning structures is formed for correctly positioning said fabric for sewing or quilting operations and for increasing safety and operational speed of sewing or quilting procedures, comprising:

a pin anchor having a first end and a second end, and a connecting solid central portion, whereby said anchor is substantially solid and can be horizontally positioned on a surface and receive a pin to anchor a piece of fabric to said surface on any surface or edge thereof, by partially piercing the anchor with said pin, whereby said surface network structure array of support, instructional, and positioning structures can be positioned on any surface of the fabric and repositioned in different configurations and sizes as desired.

5. The device of claim 4, wherein said first end of said pin anchor is circular in configuration.

6. The device of claim 4, wherein said second end is circular in configuration.

7. The device of claim 4, wherein said pin anchor is square in configuration.

8. The device of claim 4, wherein said pin anchor has one or more planar surfaces.

9. The device of claim 4, wherein said pin anchor has one or more planar surfaces shaped as a rectangle.

10. The device of claim 4, wherein said pin anchor has one or more planar surfaces triangular in shape.

11. The device of claim 4, wherein said pin anchor has one or more planar surfaces circular in shape.

12. The device of claim 4, wherein said pin anchor is configured as a cube.

13. The device of claim 4, wherein said pin anchor is configured as a shell or other irregular or abstract shape.

14. The device of claim 4, wherein said pin anchor is composed of silicone rubber.

15. The device of claim 4, wherein said pin anchor is provided in a selected color, or partially colored, or other color indicia, to allow color coding and placement instruction for safety and for providing guidance on the placement and type of stitch or quilting procedure that is appropriate.

16. A device for holding two or more pieces of fabric together in a desired position for sewing or quilting procedures, for increasing safety, sewing speed, and confidence, where a surface network of fabric positioning structures and color-coded indicators is formed by a plurality of said devices so that a surface network of fabric positioning structures is formed for correctly positioning said fabric for sewing or quilting operations and for increasing safety and operational speed of sewing or quilting procedures, comprising:

a pin anchor having a first end and a second end, and a connecting central portion; said central portion is ½ inch in length and ⅜ inch in diameter; said first end and said second end are circular and have a flat surface ⅜ inch in diameter; said pin anchor being composed of silicone rubber and where said central portion is curved and colored to provide a color-coded indicator that may be for safety indicia, and may be used to indicate stitch type or style, whereby said anchor can be positioned on a fabric surface and receive a pin to anchor a piece of fabric to said surface of the pin anchor, or to any edge thereof, by partially piercing the anchor with said pin, so that a surface network of fabric positioning structures and color-coded indicators is formed by a plurality of said pin anchors forming a surface structure array, thereby increasing safety, sewing and quilting speed and accuracy, and which can be positioned on any surface of the fabric and repositioned in different configurations and sizes as desired.

* * * * *

UNITED STATES PATENT AND TRADEMARK OFFICE

CERTIFICATE OF CORRECTION

PATENT NO. : 8,844,777 B2
APPLICATION NO. : 12/930127
DATED : September 30, 2014
INVENTOR(S) : Loretta Ivison It is certified that error appears in the above-identified patent and that said Letters Patent is hereby corrected as shown below:

In the Specification,

Col. 4, line 46, change 'Of' to --of--.

Col. 5, line 2, change 'included' to --include--.

Signed and Sealed this
Twenty-third Day of December, 2014

Michelle K. Lee

Michelle K. Lee
*Deputy Director of the United States Patent and Trademark Office*